US010244831B2

(12) United States Patent
Dukerschein et al.

(10) Patent No.: US 10,244,831 B2
(45) Date of Patent: Apr. 2, 2019

(54) TWO-PART WATCH STRAP

(71) Applicant: Samsonite IP Holdings S.àr.l., Luxembourg (LU)

(72) Inventors: Jon Karl Dukerschein, San Francisco, CA (US); Bryan Lee Hynecek, Redwood City, CA (US)

(73) Assignee: Samsonite IP Holdings S.àr.l., Luxembourg (LU)

( * ) Notice: Subject to any disclaimer, the term of this patent is extended or adjusted under 35 U.S.C. 154(b) by 333 days.

(21) Appl. No.: 14/989,623

(22) Filed: Jan. 6, 2016

(65) Prior Publication Data

US 2017/0188669 A1 Jul. 6, 2017

(51) Int. Cl.

| | |
|---|---|
| ***A44C 5/00*** | (2006.01) |
| ***A44C 5/20*** | (2006.01) |
| ***A44C 5/14*** | (2006.01) |
| ***A44B 11/20*** | (2006.01) |
| ***A44B 17/00*** | (2006.01) |
| ***A44B 11/22*** | (2006.01) |

(52) U.S. Cl.

CPC ..... *A44C 5/2071* (2013.01); *A44B 11/20* (2013.01); *A44B 11/22* (2013.01); *A44B 17/0023* (2013.01); *A44B 17/0041* (2013.01); *A44B 17/0076* (2013.01); *A44C 5/0053* (2013.01); *A44C 5/14* (2013.01)

(58) Field of Classification Search

CPC ..... A44C 5/2071; A44C 5/0053; A44C 5/14; A44B 11/20; A44B 17/0023; A44B 17/0041; A44B 17/0076; A44B 11/006; Y10T 24/47; Y10T 24/4736

USPC ..... 368/282; 24/265 B, 166, 176, 265 R, 24/265 H, 270, 271, 265 BC; 224/152, 224/164; 2/321, 322

See application file for complete search history.

(56) References Cited

U.S. PATENT DOCUMENTS

| | | | | | |
|---|---|---|---|---|---|
| 410,260 | A * | 9/1889 | Bagley | A44B 11/2526 | |
| 1,851,733 | A * | 3/1932 | Shapiro | A44C 5/2071 | 24/20 EE |
| 2,466,742 | A * | 4/1949 | Roehrl | A44B 11/20 | 24/176 |
| 3,930,287 | A * | 1/1976 | Grise | A44C 5/0053 | 24/16 PB |

* cited by examiner

*Primary Examiner* — Jack W Lavinder
(74) *Attorney, Agent, or Firm* — Haug Partners LLP

(57) ABSTRACT

A two-part watch strap (1) including a clasping part (2) and a clasped part (3). The clasping part (2) includes: a clasping-part watch-attaching end; a clasping end opposite the clasping-part watch-attaching end; a strap/band/bracelet portion (4) extending between the watch-attaching and clasping ends of the clasping part (2); and a groove (11) arranged in the strap/band/bracelet portion (4). The clasped part (3) includes: a clasped-part watch-attaching end; a free end (9) opposite the clasped-part watch-attaching end; a strap/band/bracelet portion (6) extending between the watch-attaching and free ends of the clasped part (3); and a protruding portion (10) adjacent to, near, or at the free end (9). The protruding portion (10) is configured to engage with and at least partially lock into the groove (11) of the clasping part (2) so as to secure the free end (9) of the clasped part (3) to the clasping part (2).

5 Claims, 8 Drawing Sheets

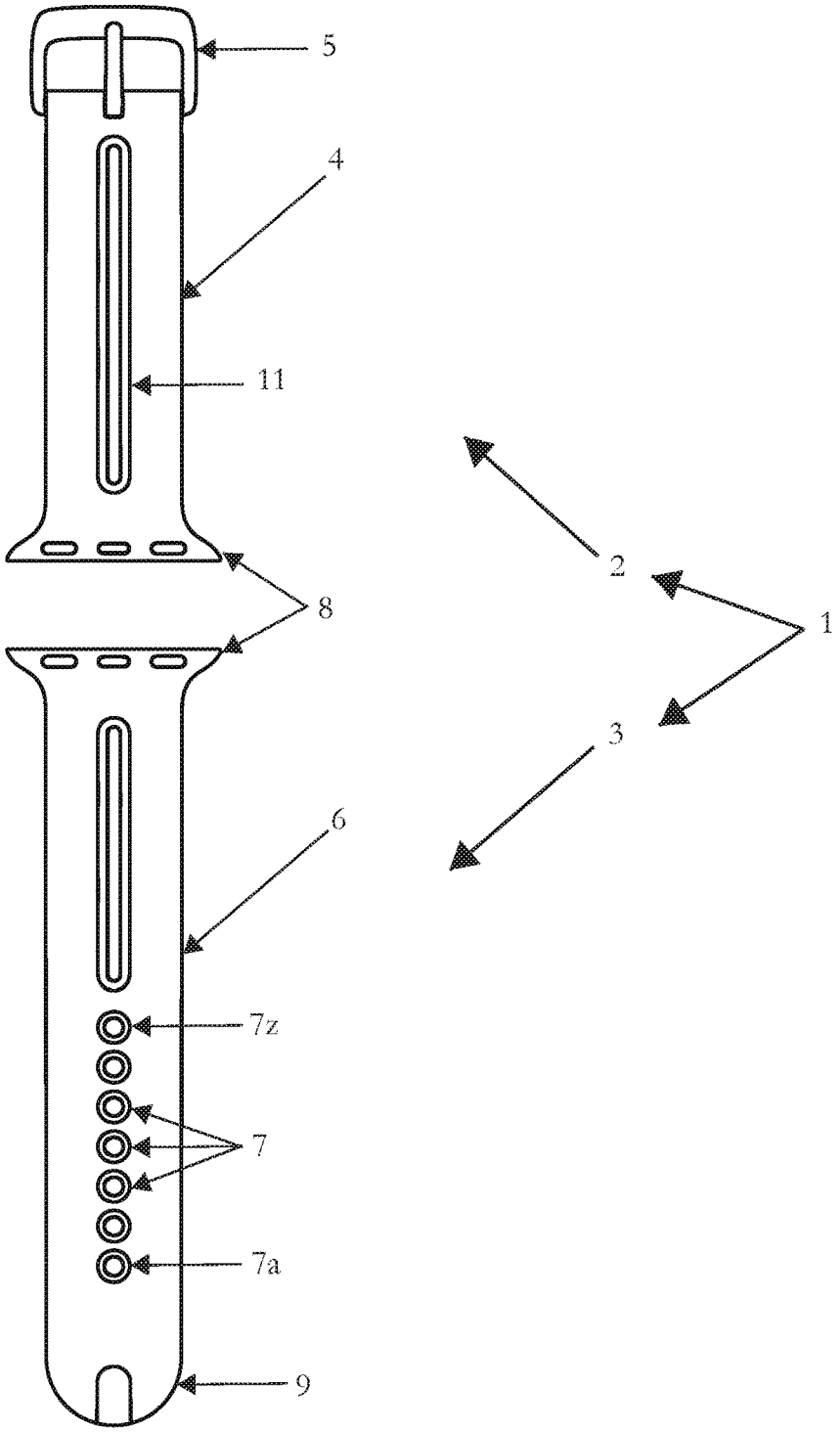
Fig. 1.1

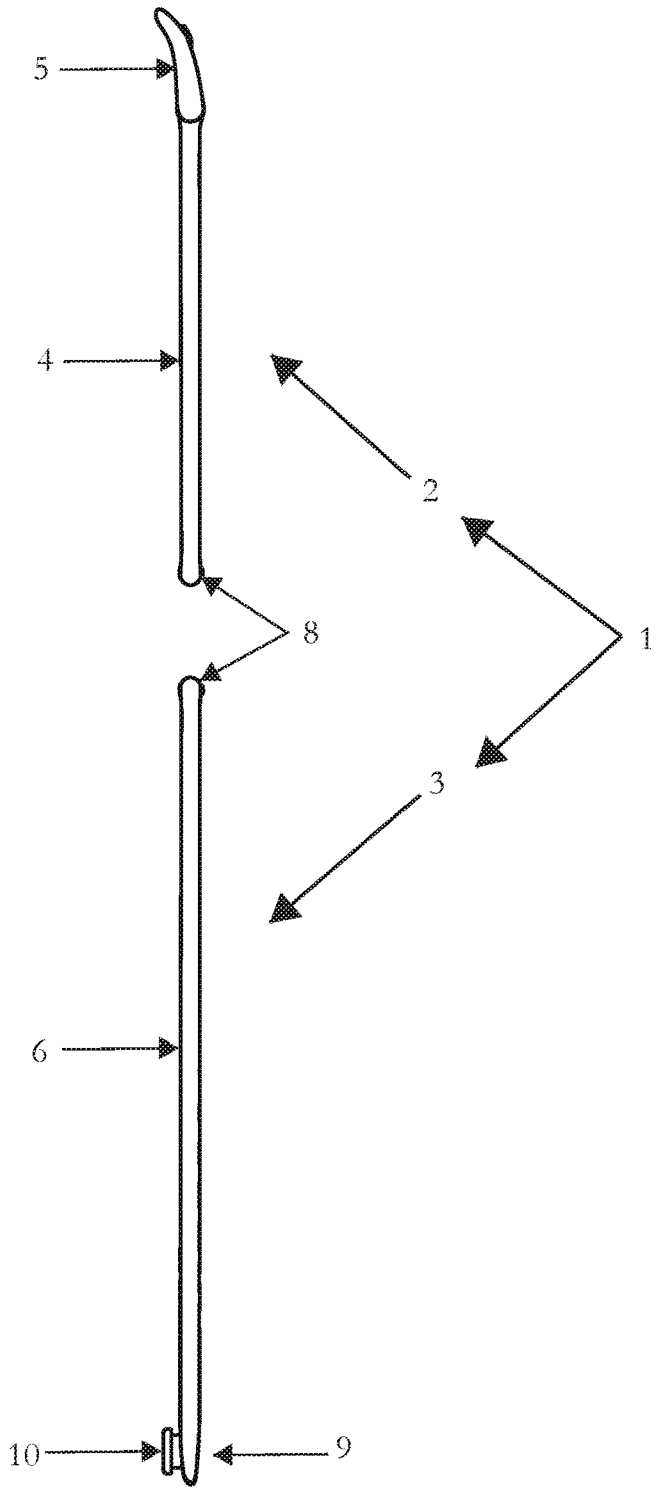
Fig. 1.2

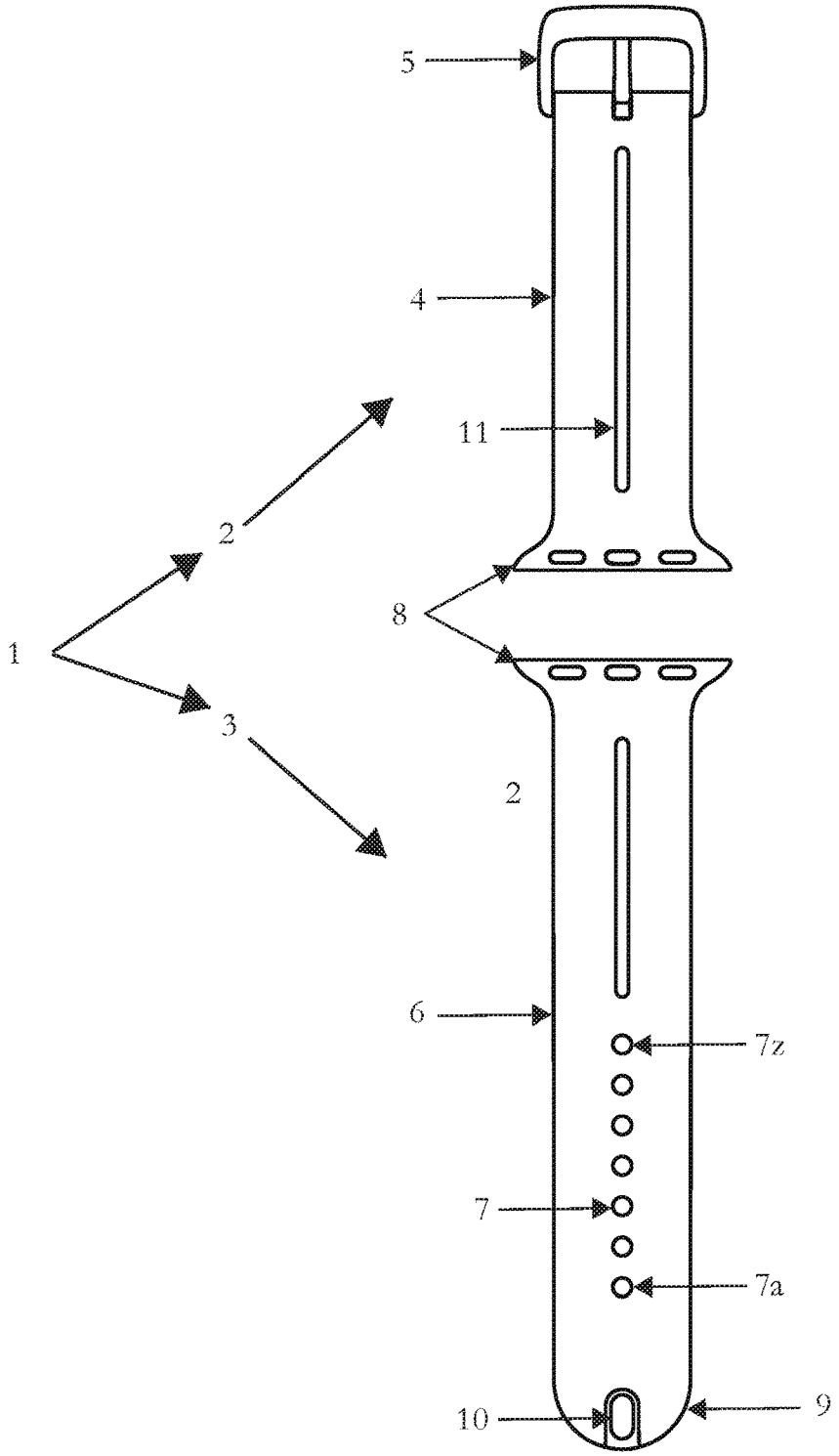
Fig. 1.3

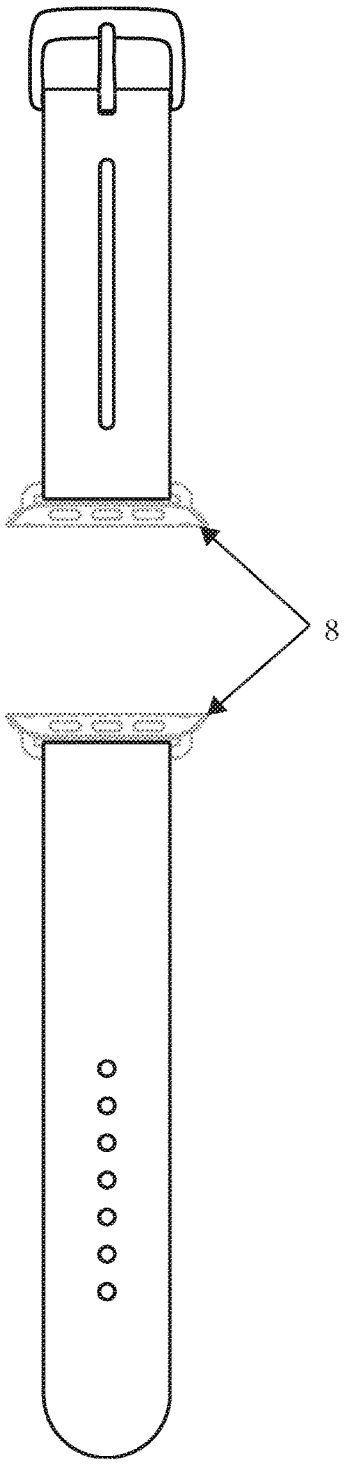
Fig. 2.1

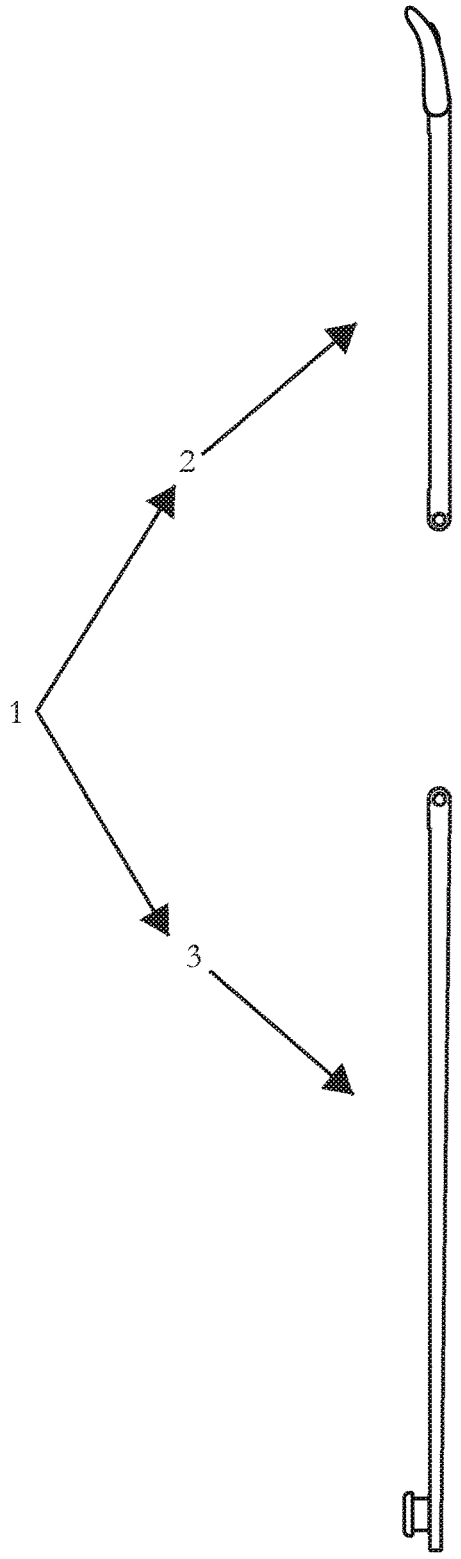
Fig. 2.2

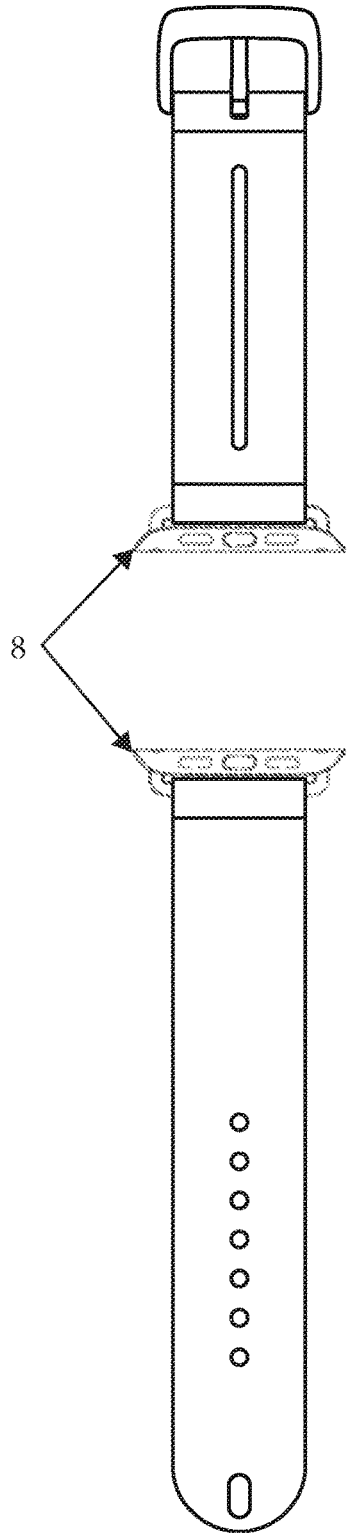
Fig. 2.3

TWO-PART WATCH STRAP

FIELD OF THE INVENTION

The present invention relates to a two-part watch strap having clasping part (e.g., a buckle part) and clasped part (e.g., a hole part) that engages with the clasp of the clasping part to secure a watch to the wrist of a user. In a preferred embodiment, the two-part watch strap has a keeperless strap management system that does not need a strap keeper or loop to keep the tail end of the clasped part secured against the clasping part of the strap when the strap is used to secure a watch to the wrist of a user.

Two-part watch straps with a buckle part and a hole part typically have a strap keeper or loop to secure the free end (i.e., the end not connected to the watch) of the hole part against the strap portion of the buckle part. In order to secure a watch to a user's wrist using such a two-part strap, a user will have to select one of the multiple holes in the hole part in which to secure the buckle of the buckle part. Which hole is selected will determine how far the free end of the hole part extends from the buckle. So to secure the free end of the hole part to the buckle part, the keeper/loop of the buckle part must be able to slide along the strap portion of the buckle part so that not too much of the free end of the hole part extends past the keeper/loop. As a result the keeper/loop isn't always effective. In particular, the sliding of the keeper/loop allows it to inadvertently slip off the free end of the hole part, allowing the hole part to unexpectedly disengage from the buckle of the buckle part. This can result in a lost or broken watch. On the other hand, the sliding of the keeper/loop also allows it to inadvertently slip too close to the buckle, allowing too much of the free end of the hole part to extend past the keeper/loop. In such an instance, the free end of the hole part dangles out away from the rest of the watch strap and can get caught on clothing or other objects.

SUMMARY OF THE INVENTION

As such, there is a need for a two-part watch strap that does not need a strap keeper or loop to keep the tail end of the clasped part of the strap secured against the clasping part of the strap when the strap is used to secure a watch to the wrist of a user.

According to the present invention there is therefore provided an two-part watch strap as described by way of example below and in the accompanying claims.

In one embodiment of the invention there is provided a two-part watch strap (1) including a clasping part (2) and a clasped part (3). The clasping part (2) includes: a clasping-part watch-attaching end that is proximal to a watch when the two-part strap is attached to the watch; a clasping end, opposite the watch-attaching end of the clasping part, that is distal from the watch when the two-part strap is attached to the watch; a clasping-part strap, band, or bracelet portion (4) that extends between the watch-attaching end of the clasping part (2) and the clasping end of the clasping part (2); and a groove (11) arranged in the clasping-part strap, band, or bracelet portion (4). The clasped part (3) includes: a clasped-part watch-attaching end that is proximal to the watch when the two-part strap is attached to the watch; a free end (9), opposite the watch-attaching end of the clasped part, that is distal from the watch when the two-part strap is attached to the watch; a clasped-part strap, band, or bracelet portion (6) that extends between the watch-attaching end of the clasped part (3) and the free end (9) of the clasped part (3); and a protruding portion (10) arranged adjacent to, near, or at the free end (9) of the clasped part (3). The protruding portion (10) is configured to engage with and at least partially lock into the groove (11) of the clasping part (2) so as to secure the free end (9) of the clasped part (3) to the clasping part (2).

In another embodiment, the protruding portion (10) is configured to engage with and at least partially lock into the groove (11) of the clasping part (2) by snapping into the groove (11).

In yet another embodiment, the clasping part (2) further includes a clasp (5) that is secured to the clasping-part strap, band, or bracelet portion (4) at the clasping end of the clasping part (2).

In a further embodiment, the clasp (5) includes a buckle or a deployment clasp.

In yet a further embodiment, the clasped part (3) further includes at least one clasped portion (7) configured to be secured to the clasping end of the clasping part (2) to secure the watch to a wrist of a user when the two part strap (1) is attached to the watch In another embodiment, the clasped portion includes at least one hole configured to engage with the clasping end of the clasping part (2) to secure the clasping end of the clasping part (2) to the clasped part (3).

In yet another embodiment, the clasped portion comprises a plurality of holes that are spaced apart longitudinally along at least a portion of the clasped portion and are configured to engage with the clasping end of the clasping part (2).

In a further embodiment, the plurality of holes of the clasped portion includes a free-end-closest hole (7*a*) closest to the free end (9) of the clasped part (3), and a free-end-furthest hole (7*z*) furthest from the free end (9) of the clasped part (3).

In yet a further embodiment, at least one clasped portion (7) includes a plurality of clasped portions (7). The plurality of the clasped portions includes a free-end-closest clasped portion (7*a*) closest to the free end (9) of the clasped part (3), and a free-end-furthest clasped portion (7*z*) furthest from the free end (9) of the clasped part (3).

In another embodiment, the groove (11) of the clasping part (2) has a length equal to or greater than a length of the clasped portion (7).

In yet another embodiment, the groove (11) of the clasping part (2) has the length equal to or greater than a length of the clasped portion (7) so that the protruding portion (10) can slide along the groove (11) when the protruding portion (10) is engaged with and at least partially locked into the groove (11).

In a further embodiment, at least one of the clasping part (2) and the clasped part (3) further includes a watch attaching portion (8) configured to attach the corresponding part (2, 3) of the two part watch strap to the watch.

In yet a further embodiment, the watch attaching portion (8) is contiguous and integral with the corresponding part (2, 3) of the two part watch strap.

In another embodiment, the watch attaching portion (8) is separate and distinct from the corresponding part (2, 3) of the two part watch strap.

In yet another embodiment, the separate and distinct watch attaching portion (8) is permanently affixed to the corresponding part (2, 3) of the two part watch strap.

In a further embodiment, the separate and distinct watch attaching portion (8) is removable from the corresponding part (2, 3) of the two part watch strap.

In another embodiment, the groove (11) is formed by a portion of the clasping part (2) that comprises a pliable material.

In yet another embodiment, a portion of the protruding portion (10), which engages with and at least partially locks into the groove (11) of the clasping part (2), comprises a pliable material.

In a further embodiment, the pliable material comprises at least one material selected from the group consisting of non-thermoplastic elastomer, thermoplastic elastomer, rubber, leather, synthetic fabrics, synthetic leathers, and foams.

In yet a further embodiment, at least one of the clasping part (2) and the clasped part (3) comprises a rigid, non pliable material.

In another embodiment, the rigid, non pliable material comprises at least one material selected from the group consisting of metal, polycarbonate, hard plastic, wood, and carbon fiber.

In yet another embodiment, the clasping-part strap, band, or bracelet portion (4) extends between the watch-attaching end of the clasping part (2) and the clasping end of the clasping part (2) in a clasping-part longitudinal direction. And the groove (11) extends longitudinally along at least a portion of the clasping-part strap, band, or bracelet portion (4) in the longitudinal direction.

In a further embodiment, the groove (11) is centrally located, in a clasping-part transverse direction orthogonal to the clasping-part longitudinal direction, in the clasping-part strap, band, or bracelet portion (4).

In yet a further embodiment, the protruding portion is configured to selectively engage with the groove (11) of the clasping part (2) so as to be removable from the groove (11).

In another embodiment, the protruding portion is configured to permanently engage with the groove (11).

In yet another embodiment, the protruding portion is configured to slide along the groove (11) of the clasping part (2) when the protruding portion (10) is engaged with and at least partially locked into the groove (11) of the clasping part (2).

In a further embodiment, the clasped part (3) includes a surface that extends in a clasped-part longitudinal direction and in a clasped-part transverse direction orthogonal to the clasped part longitudinal direction. The protruding portion protrudes from the surface of the clasped part (3), and is formed as a spigot including an enlarged head portion and a stem. The stem is arranged between the enlarged head portion and the surface of the clasped part (3), and has a maximum dimension in the clasped-part transverse direction that is smaller than a maximum dimension of the enlarged head portion in the clasped-part transverse direction. The groove (11) of the clasping part (2) is configured to receive and retain the protruding portion so that the stem of the protruding portion is arranged in the groove (11) and the enlarged head portion of the protruding portion abuts against an underside of the clasping-part strap, band, or bracelet portion (4) of the clasping part (2).

In yet a further embodiment, the groove (11) of the clasping part (2) comprises a stepped profile including a central groove portion in which the stem of the protruding portion is arranged when the protruding portion is received and retained in the groove (11); and a shoulder recess portion in which the enlarged head portion of the protruding portion is arranged when the protruding portion is received and retained in the groove (11). The central groove portion has a dimension between two opposite surfaces, which at least partially form the groove (11), that is smaller than the maximum dimension of the enlarged head portion in the clasped-part transverse direction.

It is noted that the features of the above-described embodiments are not exclusive to each other, and that any one of the above embodiments/features can be combined with one or more of the other embodiments/features to arrive at further embodiments.

The inventive watch strap can be designed to fit a variety of watches depending upon what securing mechanism each watch uses to secure straps thereto.

BRIEF DESCRIPTION OF THE DRAWINGS

FIGS. 1.1-1.3 show a top, a side, and a bottom, respectively, of a two-part watch strap according to an embodiment of the invention.

FIGS. 2.1-2.3 show a top, a side, and a bottom, respectively, of a two-part watch strap according to another embodiment of the invention.

DETAILED DESCRIPTION OF EMBODIMENTS

Figure 3:
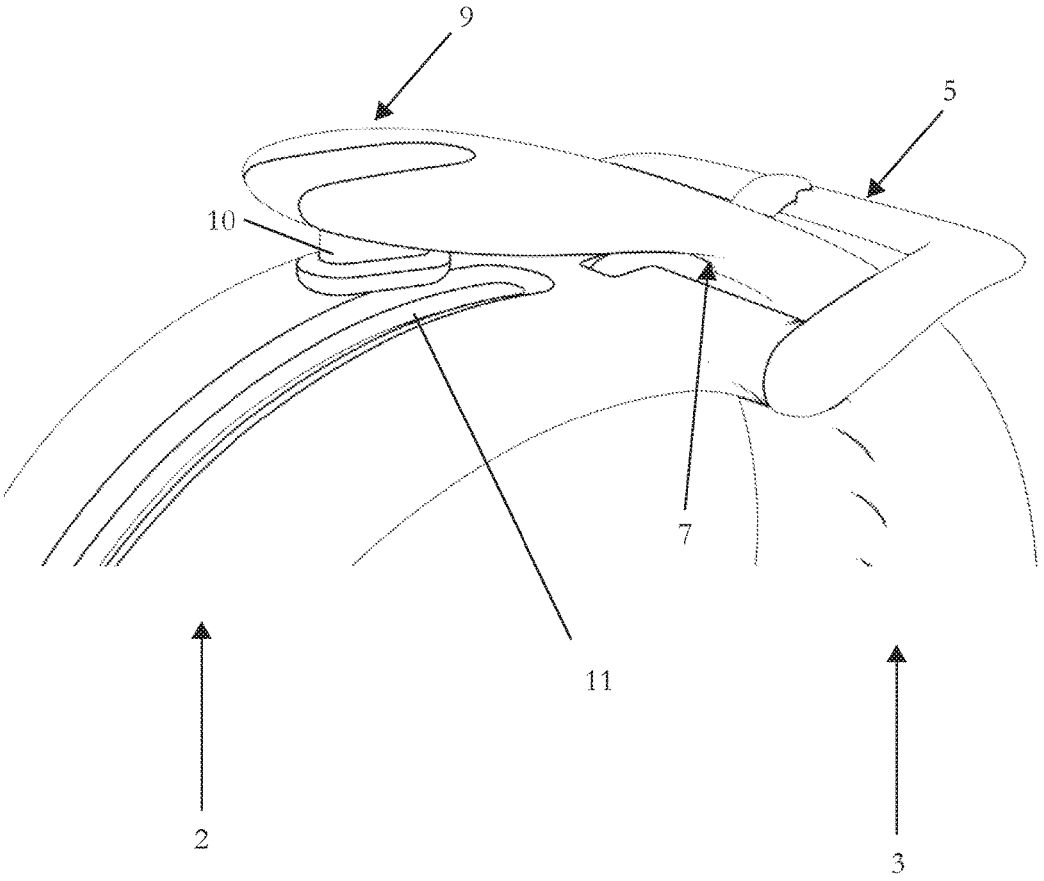
FIG. 3 shows a perspective view of the free ends of a two-part watch strap according to an embodiment of the invention in a buckled state of the strap.

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments. It is noted that any numerical ranges disclosed herein are included to individually disclose every sub-range and number, both whole integer and partial fraction, within the disclosed range. For example, a disclosed range of 1-100 is intended to individually disclose 20-90, 40-80, 30.5-50.2, 20, 67.3, 84.512924, and every other range and number that falls within the recited range.

FIGS. 1.1-1.3 show a top, a side, and a bottom, respectively, of a two-part watch strap 1 according to an embodiment of the invention. The two-part watch strap 1 has a clasping part 2 and a clasped part 3. The clasping part 2 has a strap portion 4 and a clasp 5—such as a buckle, deployment clasp, or other clasp. The clasped part 3 includes a strap portion 6 and a clasped portion or portions 7—such as one or more holes—that engages with the clasp 5 of the clasping part 2 to secure a watch (not shown) to the wrist of a user when the two-part strap 1 is attached to the watch.

Each of the clasping part 2 and the clasped part 3 includes a watch attaching portion 8 to attach each of the two strap parts to a watch. Each watch attaching portion 8 may be formed by a corresponding strap portion 4, 6 itself. Alternative, as shown in the embodiment of FIGS. 2.1 and 2.3, one or more of the watch attaching portions 8 may be completely separate and distinct from the corresponding strap portion 4, 6 to link the corresponding strap portion 4, 6 the watch. In such an instance the distinct watch attaching portion(s) 8 may be permanently affixed to or removable from the corresponding strap portion 4, 6. In the case where the distinct watch attaching portion(s) 8 is removable from the corresponding strap portion 4, 6, the distinct watch attaching portion(s) 8 may not even be part of the strap 1 as finally manufactured, but instead may be an additional part purchased separately from the two-part strap 1.

Figure 4:
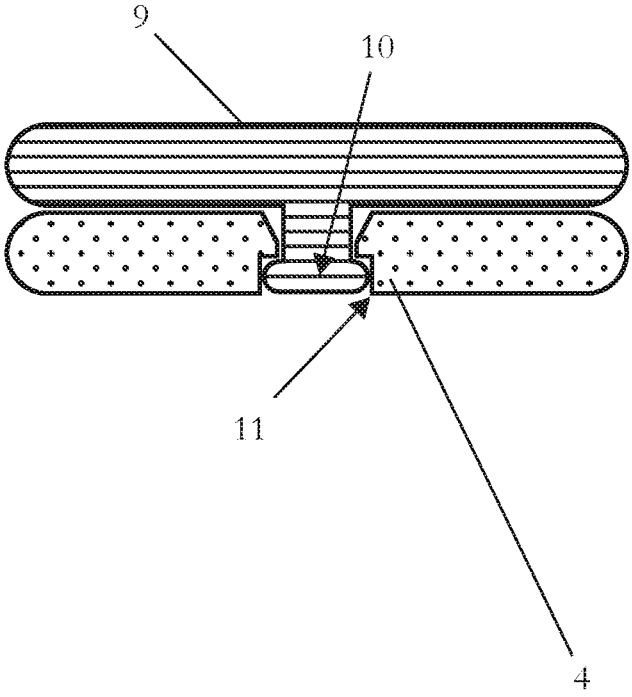
FIG. 4 shows a cross-sectional view of a two-part watch strap according to an embodiment of the invention in a state where a protruding snap at the free end of the clasped part is secured in a groove of the clasping part.

As shown in FIGS. 3 and 4, when the clasped portion(s) 7 is engaged with the clasp 5, the free end 9 of the clasped part 3 that extends past the clasp 5 is secured to the clasping part 2 via a protruding snap 10 that engages with and locks into a slot or groove 11 in the strap portion 4 of the clasping part 2. The protruding snap 10 can slide along the groove 11 to arrive at a final resting position depending on which clasped portion 7 is engaged with the clasp 5. To unlock the protruding snap 10 from the groove 11, a user must affirmatively and actively pull the free end 9 of the clasped part 3 away from the strap portion 4 of the clasping part 2. This locking feature prevents the free end 9 from coming loose from the strap portion 4, and ensures that the clasped part 3 does not unintentionally come unsecured from the clasp 5. The groove 11 may be formed to have a stepped profile, as shown in FIG. 4, to securely retain the protruding snap 10.

In a preferred embodiment, groove 11 is at least as long, or longer, than the length from the clasped portion 7*a* closest to the free end 9 to the clasped portion 7*z* furthest from the free end 9. In this way, the protruding snap 10 is allowed to slide along the groove 11, thereby reliably securing the free end 9 of the clasped part 3 to the strap portion 4 of the clasping part 2 regardless of which clasped portion 7 is engaged with the clasp 5.

The strap portions 4, 6 may be formed of any suitable watch-band materials—whether pliable or nonpliable—so long as the protruding snap 10, the groove 11, or both are formed from a pliable material (e.g., an elastomer, rubber, leather, synthetic fabrics, synthetic leathers, foams, etc.) so that the protruding snap 10 can be snapped into or through the groove 11. For example, the strap portions 4, 6 may be formed from a nonpliable and rigid material (e.g., metal, polycarbonate, hard plastic, wood, carbon fiber, etc.), while the material of the clasping part 2 in which the groove 11 is formed of a pliable material such as an elastomer, rubber, or leather. In a preferred embodiment, the strap portions 4, 6 are completely formed from a pliable material, such as a thermoplastic elastomer (which may be injection molded or otherwise molded) or leather.

It is noted that the terminology used above is for the purpose of reference only, and is not intended to be limiting. For example, terms such as "upper", "lower", "above", "below", "rightward", "leftward", "clockwise", and "counterclockwise" refer to directions in the drawings to which reference is made. As another example, terms such as "inward" and "outward" may refer to directions toward and away from, respectively, the geometric center of the component described. As a further example, terms such as "front", "rear", "side", "leftside", "rightside", "top", "bottom", "horizontal", and "vertical" describe the orientation of portions of the component within a consistent but arbitrary frame of reference which is made clear by reference to the text and the associated drawings describing the component under discussion. Such terminology will include the words specifically mentioned above, derivatives thereof, and words of similar import.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

In addition, it is noted that citation or identification of any document in this application is not an admission that such document is available as prior art to the present invention.

The invention claimed is:

1. A two-part watch strap comprising:

a clasping part comprising:

a clasping-part watch-attaching end that is proximal to a watch when the two-part strap is attached to the watch;

a clasping end, opposite the watch-attaching end of the clasping part that is distal from the watch when the two-part strap is attached to the watch;

a clasping-part strap, band, or bracelet portion that extends between the watch-attaching end of the clasping part and the clasping end of the clasping part in a clasping-part longitudinal direction; and a groove arranged in the clasping-part strap, band, or bracelet portion that extends completely through the clasping-part strap, band, or bracelet portion in a thickness direction orthogonal to the clasping-part longitudinal direction; and a clasped part comprising:

a clasped-part watch-attaching end that is proximal to the watch when the two-part strap is attached to the watch;

a free end, opposite the watch-attaching end of the clasped part, that is distal from the watch when the two-part strap is attached to the watch;

a clasped-part strap, band, or bracelet portion that extends between the watch-attaching end of the clasped part and the free end of the clasped part; and a protruding portion arranged adjacent to, near, or at the free end of the clasped part, the protruding portion being configured to engage with and at least partially lock into the groove of the clasping part so as to secure the free end of the clasped part to the clasping part;

wherein the clasped part further comprises:

at least one clasped portion configured to be secured to the clasping end of the clasping part to secure the watch to a wrist of a user when the two-part strap is attached to the watch;

wherein the groove of the clasping part has a length equal to or greater than a length of the clasped portion; and wherein the groove of the clasping part has the length equal to or greater than a length of the clasped portion so that the protruding portion can slide along the groove when the protruding portion is engaged with and at least partially locked into the groove.

2. A two-part watch strap comprising:

a clasping part comprising:

a clasping-part watch-attaching end that is proximal to a watch when the two-part strap is attached to the watch;

a clasping end, opposite the watch-attaching end of the clasping part, that is distal from the watch when the two-p art strap is attached to the watch;

a clasping-part strap, band, or bracelet portion that extends between the watch-attaching end of the clasping part and the clasping end of the clasping part in a clasping-part longitudinal direction; and a groove arranged in the clasping-part strap, band, or bracelet portion that extends completely through the clasping-part strap, band, or bracelet portion in a thickness direction orthogonal to the clasping-part longitudinal direction;

a clasped part comprising:

a clasped-part watch-attaching end that is proximal to the watch when the two-part strap is attached to the watch;

a free end, opposite the watch-attaching end of the clasped part, that is distal from the watch when the two-part strap is attached to the watch;

a clasped-part strap, band, or bracelet portion that extends between the watch-attaching end of the clasped part and the free end of the clasped part; and a protruding portion arranged adjacent to, near, or at the free end of the clasped part, the protruding portion being configured to engage with and at least partially lock into the groove of the clasping part so as to secure the free end of the clasped part to the clasping part;

wherein the groove extends longitudinally along at least a portion of the clasping-part strap, band, or bracelet portion in the longitudinal direction.

3. The two-part watch strap according to claim 2;

wherein the groove is centrally located, in a clasping-part transverse direction orthogonal to the clasping-part longitudinal direction, in the clasping-part strap, band, or bracelet portion.

4. A two-part watch strap comprising:

a clasping part comprising:

a clasping-part watch-attaching end that is proximal to a watch when the two-part strap is attached to the watch;

a clasping end, opposite the watch-attaching end of the clasping part, that is distal from the watch when the two-part strap is attached to the watch;

a clasping-part strap, band, or bracelet portion that extends between the watch-attaching end of the clasping part and the clasping end of the clasping part in a clasping-part longitudinal direction; and a groove arranged in the clasping-part strap, band, or bracelet portion that extends completely through the clasping-part strap band, or bracelet portion in a thickness direction orthogonal to the clasping-part longitudinal direction;

a clasped part comprising:

a clasped-part watch-attaching end that is proximal to the watch when the two-part strap is attached to the watch;

a free end, opposite the watch-attaching end of the clasped part, that is distal from the watch when the two-part strap is attached to the watch;

a clasped-part strap, band, or bracelet portion that extends between the watch-attaching end of the clasped part and the free end of the clasped part; and a protruding portion arranged adjacent to, near, or at the free end of the clasped part, the protruding portion being configured to engage with and at least partially lock into the groove of the clasping part so as to secure the free end of the clasped part to the clasping part;

wherein the protruding portion is configured to slide along the groove of the clasping part when the protruding portion is engaged with and at least partially locked into the groove of the clasping part.

5. A two-part watch strap comprising:

a clasping part comprising:

a clasping-part watch-attaching end that is proximal to a watch when the two-part strap is attached to the watch;

a clasping end, opposite the watch-attaching end of the clasping part that is distal from the watch when the two-part strap is attached to the watch;

a clasping-part strap, band, or bracelet portion that extends between the watch-attaching end of the clasping part and the clasping end of the clasping part in a clasping-part longitudinal direction; and a groove arranged in the clasping-part strap band, or bracelet portion that extends completely through the clasping-part strap, band, or bracelet portion in a thickness direction orthogonal to the clasping-part longitudinal direction;

a clasped part comprising:

a clasped-part watch-attaching end that is proximal to the watch when the two-part strap is attached to the watch;

a free end, opposite the watch-attaching end of the clasped part, that is distal from the watch when the two-part strap is attached to the watch;

a clasped-part strap band, or bracelet portion that extends between the watch-attaching end of the clasped part and the free end of the clasped part; and a protruding portion arranged adjacent to, near, or at the free end of the clasped part, the protruding portion being configured to engage with and at least partially lock into the groove of the clasping part so as to secure the free end of the clasped part to the clasping part;

wherein the clasped part comprises a surface that extends in a clasped-part longitudinal direction and in a clasped-part transverse direction orthogonal to the clasped-part longitudinal direction;

wherein the protruding portion protrudes from the surface of the clasped part and is formed as a spigot comprising:

an enlarged head portion; and a stem, arranged between the enlarged head portion and the surface of the clasped part, having a maximum dimension in the clasped-part transverse direction that is smaller than a maximum dimension of the enlarged head portion in the clasped-part transverse direction;

wherein the groove of the clasping part is configured to receive and retain the protruding portion so that the stem of the protruding portion is arranged in the groove and the enlarged head portion of the protruding portion abuts against an underside of the clasping-part strap, band, or bracelet portion of the clasping part;

wherein the groove of the clasping part comprises a stepped profile comprising:

a central groove portion in which the stem of the protruding portion is arranged when the protruding portion is received and retained in the groove; and a shoulder recess portion in which the enlarged head portion of the protruding portion is arranged when the protruding portion is received and retained in the groove; and wherein the central groove portion has a dimension between two opposite surfaces, which at least partially form the groove, that is smaller than the maximum dimension of the enlarged head portion in the clasped-part transverse direction.

* * * * *